US005332231A

United States Patent [19]

McIntosh

[11] Patent Number: 5,332,231

[45] Date of Patent: Jul. 26, 1994

[54] EXECUTIVE BALANCE TOY

[76] Inventor: Elvin R. McIntosh, 5461 Mildred Cir., Cypress, Calif. 90630

[21] Appl. No.: 28,964

[22] Filed: Mar. 10, 1993

[51] Int. Cl.[5] ..... A63F 9/00; A63H 33/04; A63H 33/00

[52] U.S. Cl. ..... 273/450; 446/85; 446/487

[58] Field of Search ..... 446/85, 97, 101, 102, 446/104, 324–326, 396, 487; 273/447, 449, 450; 434/300, 302

[56] References Cited

U.S. PATENT DOCUMENTS

| | | | |
|---|---|---|---|
| 162,141 | 4/1875 | Bayles | 273/450 |
| 644,209 | 2/1900 | Murphy | 273/450 |
| 3,188,089 | 5/1921 | Odell et al. | 273/449 |
| 3,424,455 | 1/1969 | Dunson | 273/450 |
| 3,567,221 | 3/1971 | Stults | 273/450 |
| 3,614,106 | 8/1990 | Morrison | 273/449 |
| 3,857,569 | 12/1974 | Goldfarb et al. | 273/449 |
| 4,579,346 | 4/1986 | Giuntoli | 273/449 |

*Primary Examiner*—Robert A. Hafer
*Assistant Examiner*—Jeffrey D. Carlson
*Attorney, Agent, or Firm*—Price, Gess & Ubell

[57] ABSTRACT

The executive balance toy is a balancing game assembled from precisely-machined plates. The plates interconnect and pivot with respect to one another to form a structure that pivots about two axes and includes a play surface which does not pivot about its center of gravity. The executive toy challenges a player to place as many weighted play pieces as possible on the play surface without causing it to tilt.

15 Claims, 3 Drawing Sheets

EXECUTIVE BALANCE TOY

BACKGROUND OF THE INVENTION

1. Field of the Invention

The present invention relates to toys requiring balancing skills and, more particularly, pertains to an executive toy which challenges a player to balance as many objects as possible on a surface which tilts when the objects are improperly placed thereon.

2. Description of Related Art

The art is generally cognizant of games utilizing pivoting surfaces and weighted game pieces. Representative prior art in the field of balancing games is included below.

J. A. Odell, et al., U.S. Pat. No. 3,188,089, teaches a game including a tiltable game board and game pieces of different weights. Similarly, P. M. Dunson, U.S. Pat. No. 3,424,455, describes an apparatus for a balance game. W. E. Stults, U.S. Pat. No. 3,567,221, discloses a balance bar with a plurality of pins for receiving weight elements, the balance bar pivoting on a fulcrum. H. J. Morrison, U.S. Pat. No. 3,614,106, discloses a puzzle game wherein balancing members are stacked in a vertical tandem orientation from a base. A. E. Goldfarb et al., U.S. Pat. No. 3,857,569, teaches a game apparatus wherein the players selectively attempt to wittedraw play pieces from a sensitively-balanced receptacle. D. Giuntoli, U.S. Pat. No. 4,579,346, discloses a game board that tilts about a centrally located support.

No existing balancing game teaches the assembly of precisely machined plates into a structure including a tiltable play surface. Furthermore, the art is without a balancing game which challenges players to add weighted play pieces to a structure which pivots about several axes in response to improperly placed play pieces. Similarly, no game apparatus is yet known which presents players with the additional aggravation of placing play pieces on a tiltable surface which does not tilt about its center of gravity. Lastly, no game assembly constructed of visually pleasing materials and embodying the aforementioned features is easily, inexpensively, and efficiently manufactured today.

OBJECTS AND SUMMARY OF THE INVENTION

An object is to provide an executive balance toy consisting of a set of precisely machined plates from which a structure including a tiltable play surface may be assembled and game pieces which are placed thereupon.

An additional object is to provide an executive balance toy which challenges players to add weighted play pieces to a tiltable play surface, the surface being supported by a structure that pivots about two axes in response to improperly placed play pieces.

Yet another object is to provide an executive balance toy requiring players to place game pieces upon a tiltable surface that does not pivot about its center of gravity.

Still another object is to provide an executive balance toy that embodies the above objects, is constructed of visually pleasing materials, and is easily, inexpensively, and efficiently manufactured.

The executive balance toy includes a balance plate, a support plate, a base plate, and game pieces. The plates are designed to be collectively assembled into a structure including a tiltable surface upon which the game pieces are placed. A top edge of the support plate holds the balance plate over the base plate; and a bottom edge of the support plate anchors the support plate within the base plate. The balance plate has a slot that receives the top edge of the support plate; and the base plate has an opening that receives the bottom edge of the support plate. The base plate opening and the support plate bottom edge are sized so that the support plate is free to pivot about the base plate opening, within a fixed range of angles. The balance plate slot and the support plate top edge are sized so that the balance plate is free to pivot about the support plate top edge, within a fixed range of angles. The balance plate slot is offset from the balance plate center of gravity.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best mode contemplated by the inventor of carrying out his invention. Various modifications, however, will remain readily apparent to those skilled in the art, since the generic principles of the current invention have been defined herein specifically to provide an executive balance toy which challenges a player to balance as many play pieces as possible on a surface which tilts when the play pieces are improperly placed thereon.

Figure 1:
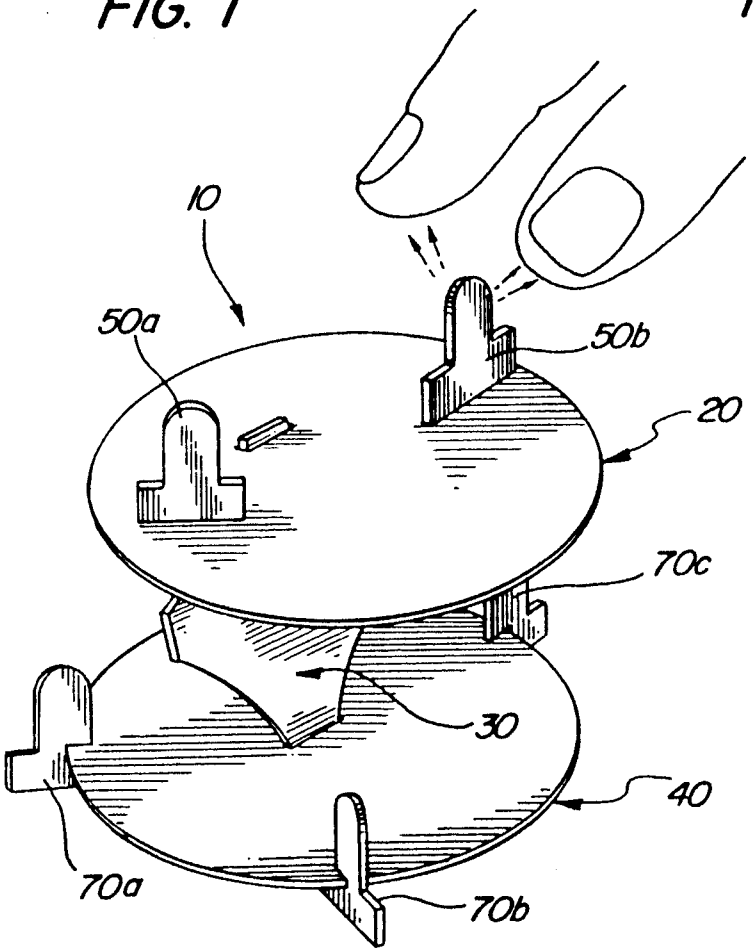
FIG. 1 is a schematic perspective showing an executive toy.

FIG. 1 shows an executive balance toy 10 including a balance plate 20, support plate 30, base plate 40, support legs 70*a*, 70*b*, 70*c*, and play pieces 50*a*, 50*b*. Balance plate 20, support plate 30, and base plate 40 are assembled together into a structure wherein support plate 30 holds balance plate 20 over base plate 40. Balance plate 20 serves as a play surface which tilts when a player improperly deposits play pieces 50 thereon. Executive balance toy 10 challenges a player to place as many play pieces 50 on tiltable balance plate 20 as possible without applying a net force to the balance plate 20 which tilts the same.

Figure 3:
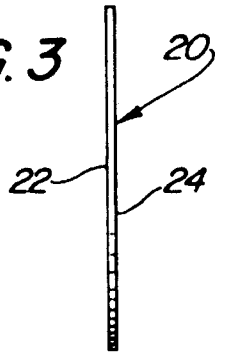
FIG. 3 is a side view of a balance plate for an executive toy.
Figure 7:
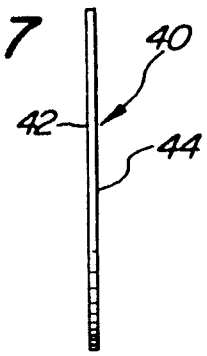
FIG. 7 is a side view of a base plate for an executive toy.
Figure 2:
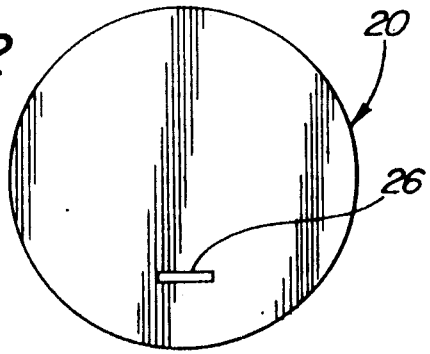
FIG. 2 is a top view of a balance plate for an executive toy.
Figure 4:
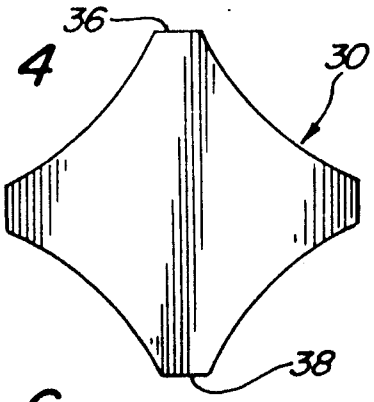
FIG. 4 is a front view of a support plate for an executive toy.

A particularly distinctive feature of executive balance toy 10 is that balance plate 20, support plate 30, and base plate 40, when properly assembled, collectively embody a structure that pivots about several axes, not just one. FIG. 2 illustrates that balance plate 20, in a preferred embodiment, is a circular disk including a balance plate slot 26 which is offset from the center of gravity of balance plate 20. FIG. 3 is a side view of balance plate 20 and identifies balance plate upper surface 22 and balance plate lower surface 24 which are substantially planar and parallel to each other. Front and side views of base plate 40 are respectively shown in FIG. 6 and FIG. 7. Base plate 40 is a circular disk including a base plate opening 46 which is preferably located at the center of gravity of base plate 40. Base plate 40 includes base plate top surface 42 and base plate bottom surface 44 which are substantially planar and parallel to each other. FIG. 4 illustrates a support plate 30 with a support plate top edge 36 and a support plate bottom edge 38. Support plate 30 also includes support plate front surface 32 and support plate back surface 34 as seen in FIG. 5.

Base plate opening 46 and support plate bottom edge 38 are sized such that support plate bottom edge 38 fits within base plate opening 46, such that support plate 30 stands upright within base plate opening 46, and such that support plate 30 is free to pivot a predetermined amount about base plate opening 46. The maximum amount that support plate 30 may pivot depends upon the precise dimensions to which base plate opening 46 and support plate bottom edge 38 are made. Similarly, support plate top edge 36 and balance plate slot 26 are sized such that support plate top edge 36 fits within balance plate slot 26 and such that balance plate 20 is free to pivot a predetermined amount about support plate top edge 36. The maximum amount that balance plate 20 may pivot depends upon the precise dimensions to which balance plate slot 26 and support plate top edge 36 are made.

The executive balance toy 10 is assembled and operates as follows. First, base plate 40 is set on a flat surface with base plate top surface 42 facing upward. Ideally, base plate 40 is machined, or otherwise formed, such that base plate top surface 42 and base plate bottom surface 44 are functionally interchangeable. In other words, either side of base plate 40 can face upward. Furthermore, base plate opening 46 begins at base plate top surface 42 and continues through base plate 40 to end at base plate bottom surface 44. In a preferred embodiment of executive balance toy 10 illustrated in FIG. 12, base plate 40 is raised above the flat surface and supported thereabove by at least three support legs 70, which provide clearance above the flat surface for support plate bottom edge 38 to be inserted into base plate opening 46. In an alternative preferred embodiment seen in FIG. 13, base plate 40 is raised above the flat surface and supported thereabove by a support base 200 with a hollow center. Similarly, support base 200 provides the clearance needed to properly insert support plate bottom edge 38 into base plate opening 46. Of course, a thicker base plate 40 with a base plate opening 46 sized to receive support plate bottom edge 38 and allow support plate 30 to pivot a predetermined amount could be manufactured, thus obviating the need for support legs 70 or support base 200.

Figure 5:
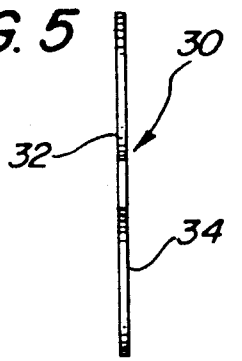
FIG. 5 is a side view of a support plate for an executive toy.
Figure 6:
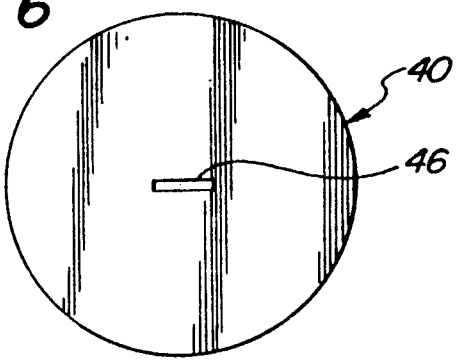
FIG. 6 is a top view of a base plate for an executive toy.

As seem in FIG. 4 and FIG. 5, support plate front surface 32 and support plate back surface 34 are both adjacent to support plate top edge 36 and support plate bottom edge 38. A shortest distance between support plate front surface 32 and support plate back surface 34 defines a support plate width. Since support plate front surface 32 and support plate back surface 34 are both planar and parallel to each other, the aforementioned support plate width is necessarily the same near both support plate top edge 36 and support plate bottom edge 38. Base plate opening 46 is substantially rectangular in shape and has an opening length and an opening width sized to accommodate support plate bottom edge 38. The size of base plate opening 46 determines how far forward or backward support plate 30 may pivot from a vertical standing position. Similarly, balance plate opening 26 begins at balance plate upper surface 22 and continues through balance plate 20 to end at balance plate lower surface 24. Balance plate slot 26 is substantially rectangular in shape and has a slot length and a slot width sized to accommodate support plate top edge 36. The size of balance plate slot 26 determines how much balance plate 20 may pivot about support plate top edge 36. Lastly, the width of support plate 30 is necessarily smaller than both the slot width and the opening width.

Support plate bottom edge 38 and base plate opening 46 are sized such that support plate 30 may pivot, either forward or backward, no more than a predetermined amount. With support plate 30 leaning the full predetermined amount, balance plate 20 is next lowered over support plate 30. More specifically, support plate top edge 36 is fitted into balance plate slot 26 with balance plate 20 oriented such that its center of gravity is directly above support plate 30. Support plate top edge 36 and balance plate slot 26 are sized such that balance plate 20 may pivot a predetermined amount about support plate top edge 36 and such that balance plate 20 stops pivoting at a substantially horizontal position when executive balance toy 10 is assembled as described above.

Figure 12:
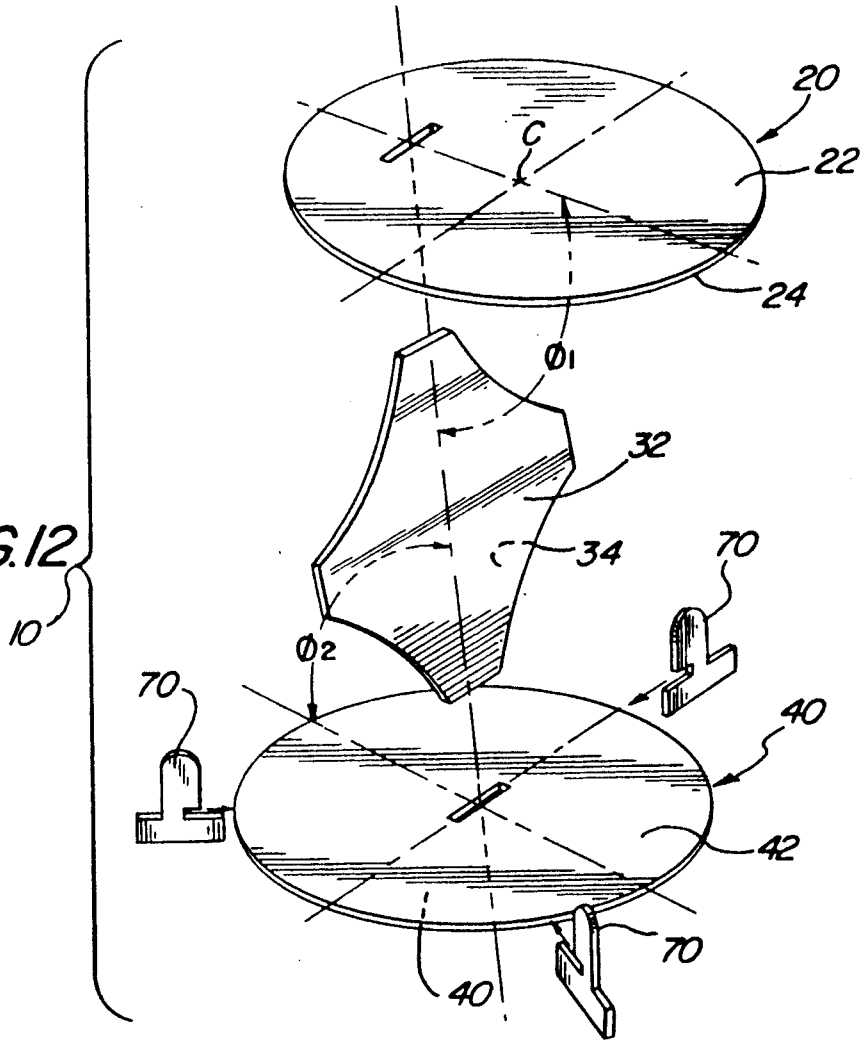
FIG. 12 is an expanded view of an executive toy with three support legs.

FIG. 12 exemplifies the assembly and utilization of executive balance toy 10. A first angle ($\phi_1$) is formed by balance plate lower surface 24 and support plate forward surface 32. A second angle ($\phi_2$) is formed by base plate top surface 42 and support plate back surface 34. The width of support plate top edge 36 and the width of balance plate slot 26 determine first angle ($\phi_1$) at its minimum angle. Similarly, the width of support plate bottom edge 38 and the width of base plate opening 46 determine second angle ($\phi_2$) at its minimum angle. In a preferred embodiment, support plate 30 supports balance plate 20 in a substantially horizontal position with the first angle and the second angle being substantially equal. Support plate front surface 32 and support plate back surface 34 engage the edges of plate slot 26 and base plate opening 46, defining their respective lengths.

The width of support plate top edge 36 and the width of balance plate slot 26 are substantially equal, as are the widths of balance plate slot 26 and base plate opening 46, allowing for the initial balance to be substantially horizontal (i.e., $\phi_1=\phi_2$).

When a player improperly places game pieces 50 on balance plate 20, the player creates a net force sufficient to pivot balance plate 20 out of its substantially horizontal position. This can happen in two ways. First, balance plate 20 can pivot about support plate top edge 36. Second, support plate 30 and 130 can pivot about base plate opening 46. In either case, balance plate 20 tilts and play pieces 50 accordingly tumble downward.

Figure 13:
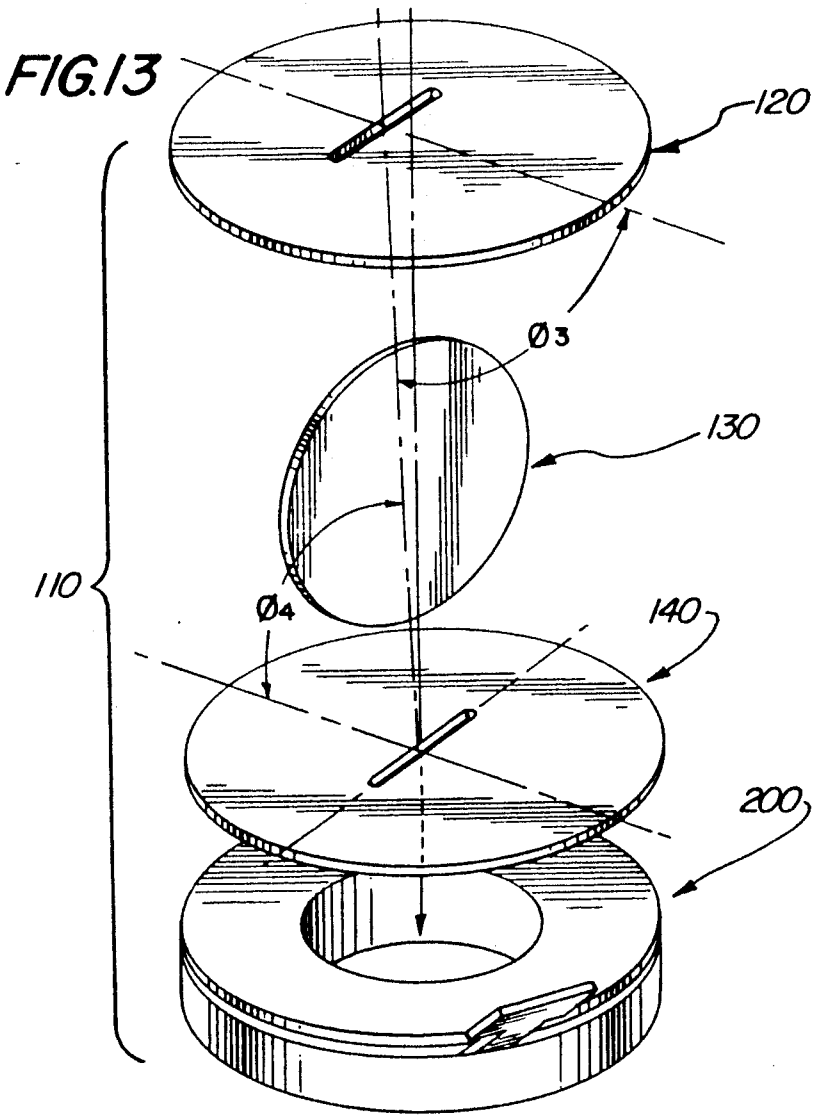
FIG. 13 is an expanded view of an alternative embodiment of the executive toy with a support base and a play piece.

With respect to materials, balance plate 20, support plate 30, and base plate 40 are preferably made from copper, brass, aluminum, or a suitable plastic. As illustrated in FIG. 12 and FIG. 13, support plate 30 and 130 may be manufactured in a variety of shapes, e . g. , a football, baseball, heart, corresponding to the festive event at hand.

As with base plate 40, balance plate 20 is machined, or otherwise formed, such that balance plate upper surface 22 and balance plate lower surface 24 are functionally interchangeable. Thus, either side of balance plate 20 can face upward, so long as balance plate 20 is oriented such that its center of gravity is above support plate 30. Likewise, support plate 30 is machined, or otherwise formed, such that support plate front surface 32 and support plate back surface 34 are functionally interchangeable. Accordingly, either side of support plate 30 can face forward.

Another distinctive feature of executive balance toy 10 is that it requires players to place game pieces 50 upon a tiltable balance plate 20 that does not pivot about its center of gravity. FIG. 12 shows that balance plate slot 26 is an offset distance from the center of gravity (C) of balance plate 20. This feature makes proper placement of play pieces 50 even more difficult for players of executive balance toy 10.

Figure 9:
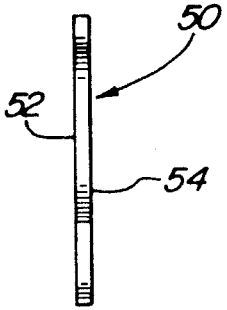
FIG. 9 is a side view of a play piece for an executive toy.
Figure 8:
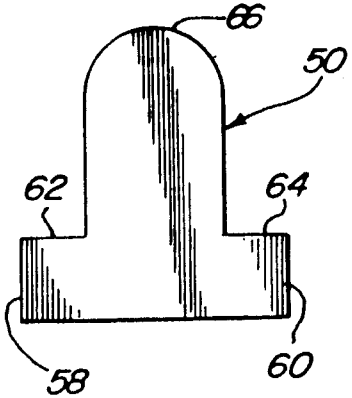
FIG. 8 is a front view of a play piece for an executive toy.

FIG. 8 and FIG. 9, respectively, show a front and a side view of a play piece 50. Play pieces 50 include play piece front surface 52 and play piece back surface 54 which are planar and parallel to each other. Play piece bottom surface 56, as seen in FIG. 8, is also planar. Adjacent to play piece bottom surface 56 are play piece left surface 58 and play piece right surface 60. The upper portion of play piece 50 includes play piece top-left surface 62, play piece top-right surface 64, and play piece top-center surface 66. Play piece top-left surface 62 is adjacent to play piece left surface 58. Play piece top-right surface 64 is adjacent to play piece right surface 60. Play piece top-center surface 66 is bounded on opposing sides by play piece top-left surface 62 and play piece top-right surface 64.

Figure 11:
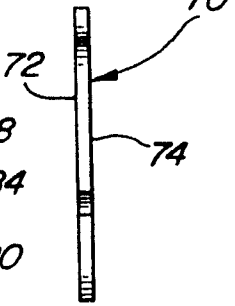
FIG. 11 is a side view of a support leg for an executive toy.
Figure 10:
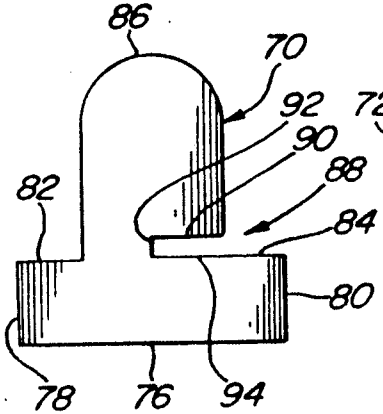
FIG. 10 is a front view of a support leg for an executive toy.

Executive balance toy 10 also includes support legs 70 as seen in FIG. 10 and FIG. 11. Support legs 70 are identical to play pieces 50 with the exception of added support leg notch 88. Support leg notch 88 includes support leg notch upper surface 90, support leg notch back surface 92, and support leg notch lower surface 94. FIG. 12 shows how base plate 40 is fit into support leg notch 88. Accordingly, support leg notch 88 is closely sized to receive base plate 40. Support leg front surface 72, support leg back surface 74, support leg bottom surface 76, support leg left surface 78, support leg right surface 80, support leg top-left surface 82, support leg top-right surface 84, and support leg top-center surface 86, as illustrated in FIG. 10 and FIG. 11, interconnect as do their play piece namesakes of FIG. 8 and FIG. 9.

FIG. 13 shows an alternative executive balance toy 110 including alternative balance plate 120, alternative support plate 130, alternative base plate 140, and support base 200. Those skilled in the art will appreciate that alternative support plate 130, which is shown as a circular disk, necessarily requires a balance plate slot and a base plate opening of greater length. As with the embodiment illustrated in FIG. 12, alternative balance plate 120 is supported in a substantially horizontal position by alternative support plate 130 to form a third angle ($\phi$) substantially equal to a fourth angle ($\phi_4$).

Figure 14:
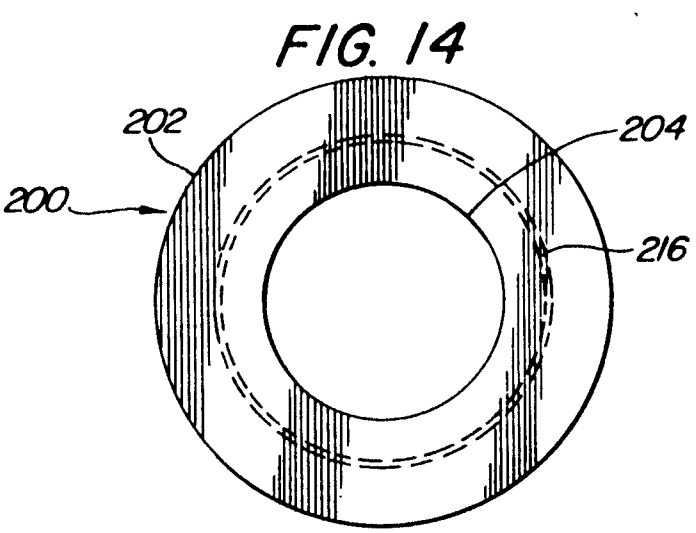
FIG. 14 is a top view of a support base for an executive toy.
Figure 15:
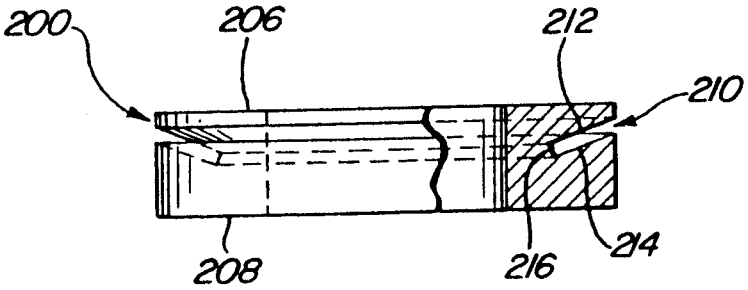
FIG. 15 is a side view of a support base for an executive toy.

FIG. 14 and FIG. 15, respectively, are top and side views of support base 200. Support base outer surface 202 circumscribes support base inner surface 204, as seen in the top view. FIG. 15 shows support base top surface 206 upon which is placed base plate 40, 140. Support base top surface 206 and support base bottom surface 208 are both planar and parallel to each other. Support base 200 further includes support base channel 210 into which are inserted play pieces 50. Support base channel 210 resides on support base outer surface 202 and includes support channel upper surface 212, support channel lower surface 214, and support channel back surface 216.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An executive balance toy comprising:

a balance plate with an upper surface and a lower surface, the lower surface including a slot located an offset distance from a center of gravity of the balance plate;

a base plate with a top surface and a bottom surface, the top surface including an opening;

a support plate with a top edge fitting within said balance plate slot and a bottom edge fitting within said base plate opening, the support plate supporting said balance plate above said base plate in a substantially horizontal position, said balance plate being rotated out of the substantially horizontal position by one of said balance plate pivoting about the top edge of the support plate or the support plate pivoting about said base plate opening, when a sufficient net force is applied to said balance plate upper surface; and a plurality of play pieces which a player strategically places on said balance plate upper surface in an effort to place as many of the play pieces on said balance plate as possible without said balance plate pivoting beyond said substantially horizontal position in response to said net force created by the plurality of play pieces placed upon said balance plate upper surface.

2. The executive balance toy of claim 1 wherein said balance plate upper surface and said balance plate lower surface are substantially planar and substantially parallel to each other.

3. The executive balance toy of claim 1 wherein said balance plate slot begins at said balance plate upper surface and continues through said balance plate to end at said balance plate lower surface.

4. The executive balance toy of claim 1 wherein said support plate further includes a front surface and a back surface, both surfaces being adjacent to said support plate top edge and said support plate bottom edge, the front surface and the back surface being substantially planar and parallel to each other, said balancing plate lower surface and the support plate front surface defining a first angle and said base plate top surface and the support plate back surface defining a second angle which is substantially the same as the first angle when said balance plate is in said substantially horizontal position.

5. The executive balance toy of claim 1 wherein each of said plurality of play pieces includes a planar bottom surface.

6. The executive balance toy of claim 1 wherein said base plate top surface and said base plate bottom surface are substantially planar and substantially parallel to each other.

7. The executive balance toy of claim 1 wherein said base plate opening begins at said base plate top surface and continues through said base plate to end at said base plate bottom surface.

8. The executive balance toy of claim 1 further comprising a plurality of support legs detachably mounted to said base plate.

9. The executive balance toy of claim 8 wherein each of said plurality of support legs is substantially identical to one of said plurality of play pieces with the addition of a notched upper surface, a notched back surface, and a notched lower surface, which, in combination, define a support leg notch sized such that the notched upper surface and the notched lower surface fit closely over said base plate top surface and said base plate bottom surface, respectively.

10. The executive balance toy of claim 1 further comprising a support base upon which said base plate is detachably mounted.

11. The executive balance toy of claim 10 wherein said support base further includes a means for receiving and storing said plurality of play pieces, the play pieces being readily removed therefrom when said player wishes to place the play pieces upon said balance plate upper surface.

12. An executive balance toy comprising:

a balance plate with an upper surface and a lower surface which are substantially planar and substantially parallel to each other, the balance plate including a slot beginning at the upper surface and continuing through the balance plate to end at the lower surface, the slot being located an offset distance from a center of gravity of the balance plate;

a base plate with a top surface and a bottom surface which are substantially planar and substantially parallel to each other, the top surface including an opening beginning at the top surface and continuing through the base plate to end at the bottom surface;

a support plate with a top edge fitting within said balance plate slot and a bottom edge fitting within said base plate opening, the support plate further including a front surface and a back surface, both surfaces being adjacent to the top edge and the bottom edge, the front surface and the back surface being substantially planar and substantially parallel to each other, the support plate supporting said balance plate above said base plate in a substantially horizontal position, said balance plate being rotated out of the substantially horizontal position by one of said balance plate pivoting about the top edge of the support plate or the support plate pivoting about said base plate opening, when a sufficient net force is applied to said balance plate upper surface, said balance plate lower surface and the support plate front surface defining a first angle and said base plate top surface and the support plate back surface defining a second angle which is substantially the same as the first angle when said balance plate is in said substantially horizontal position; and a plurality of play pieces which a player strategically places on said balance plate upper surface in an effort to place as many of the play pieces on said balance plate as possible without said balance plate pivoting beyond said substantially horizontal position in response to said net force created by the plurality of play pieces placed upon said balance plate upper surface.

13. The executive balance toy of claim 12 further comprising a plurality of support legs detachably mounted to said base plate.

14. The executive balance toy of claim 13 further comprising a base upon which said base plate is detachably mounted.

15. An executive balance toy comprising:

a balance plate with an upper surface and a lower surface which are substantially planar and substantially parallel to each other, the balance plate including a slot beginning at the upper surface and continuing through the balance plate to end at the lower surface, the slot being located an offset distance from a center of gravity of the balance plate, the slot being substantially rectangular in shape and having a slot length and a slot width;

a base plate with a top surface and a bottom surface which are substantially planar and substantially parallel to each other, the base plate including an opening beginning at the top surface and continuing through the base plate to end at the bottom surface, the opening being substantially rectangular in shape and having an opening length and an opening width;

a support plate with a top edge fitting within said balance plate slot and a bottom edge fitting within said base plate opening, the support plate further including a front surface and a back surface, both surfaces being adjacent to the top edge and the bottom edge, the front surface and the back surface being substantially planar and substantially parallel to each other, a shortest distance between the front surface and the back surface defining a support plate width which is smaller than said balancing plate slot width and smaller than said base plate opening width, said balance plate lower surface and the support plate front surface defining a first angle and said base plate top surface and the support plate back surface defining a second angle, the support plate width, said balancing plate slot width, and said base plate opening width being sized such that the support plate supports said balance plate above said base plate in a substantially horizontal position, the first angle being substantially the same as the second angle when said balance plate is in the substantially horizontal position, said balance plate being rotated out of the substantially horizontal position by one of said balance plate pivoting about the top edge of the support plate or the support plate pivoting about said base plate opening, when a sufficient net force is applied to said balance plate upper surface; and a plurality of play pieces which a player strategically places on said balance plate upper surface in an effort to place as many of the play pieces on said balance plate as possible without said balance plate pivoting beyond said substantially horizontal position in response to said net force created by the plurality of play pieces placed upon said balance plate upper surface.

* * * * *